US011025003B2

(12) United States Patent
Hanji et al.

(10) Patent No.: US 11,025,003 B2
(45) Date of Patent: Jun. 1, 2021

(54) CONNECTOR

(71) Applicant: Sumitomo Wiring Systems, Ltd., Mie (JP)

(72) Inventors: Asuka Hanji, Mie (JP); Yukihiro Fukatsu, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/711,586

(22) Filed: Dec. 12, 2019

(65) Prior Publication Data

US 2020/0203891 A1 Jun. 25, 2020

(30) Foreign Application Priority Data

Dec. 21, 2018 (JP) ..... JP2018-239106

(51) Int. Cl.
*H01R 13/629* (2006.01)

(52) U.S. Cl.
CPC . *H01R 13/62911* (2013.01); *H01R 13/62927* (2013.01)

(58) Field of Classification Search
CPC ..... H01R 13/62905–62927
USPC ..... 439/157
See application file for complete search history.

(56) References Cited

U.S. PATENT DOCUMENTS 6,083,017 A * 7/2000 Matsumura ..... H01R 13/62933 439/157
6,155,851 A * 12/2000 Kazuhara ..... H01R 13/62905 439/157
9,287,662 B2 * 3/2016 Suzuki ..... H01R 13/62977
2005/0048820 A1 * 3/2005 Yamashita ..... H01R 13/514 439/157
2005/0136714 A1 * 6/2005 Morikawa ..... H01R 13/62911 439/157
2009/0317993 A1 * 12/2009 Komiyama ..... H01R 13/62977 439/157
2014/0242822 A1 * 8/2014 Suzuki ..... H01R 13/56 439/157
2017/0110830 A1 * 4/2017 Yamada ..... H01R 13/62927
2017/0256888 A1 9/2017 Matsuura et al.

FOREIGN PATENT DOCUMENTS

JP 2017-157503 9/2017

* cited by examiner

*Primary Examiner* — Gary F Paumen
(74) *Attorney, Agent, or Firm* — Gerald E. Hespos; Michael J. Porco; Matthew T. Hespos

(57) ABSTRACT

A housing (10) is formed with a partial locking stopper (21) and a full locking stopper (24). A slide lever (25) (operating member) is formed with a single hook (33) having a partial locking contact surface (35) and a full locking contact surface (36). The partial locking contact surface (35) is at an acute angle to a sliding direction of the slide lever (25) and restricts a movement of the slide lever (25) at the partial locking position in a direction separating from the housing (10) by contacting the partial locking stopper (21). The full locking contact surface (36) is at an obtuse angle to the sliding direction of the slide lever (25) and restricts a movement of the slide lever (25) at the full locking position toward the partial locking position by contacting the full locking stopper (24) in a semi-locked state.

8 Claims, 10 Drawing Sheets

CONNECTOR

BACKGROUND

Field of the Invention

The invention relates to a connector.

Related Art

Japanese Unexamined Patent Publication No. 2017-157503 discloses a connector with a boosting mechanism. This connector is configured by mounting a slide lever having a boosting function into a fitting-side housing. The slide lever is slid from an initial position to a connection position, and this movement causes a cam follower of a waiting-side housing to slide in a cam groove of the slide lever. Thus, the boosting function is exhibited, and the waiting-side housing and the fitting-side housing are connected with a small operation force. The waiting-side housing and the fitting-side housing are separated with a small operation force by moving the slide lever from the connection position to the initial position while the housings are connected.

The slide lever has a projection for holding the slide lever at the initial position and the connection position. The fitting-side housing is formed with a separation restricting stopper and a connected state holding stopper. The slide lever that is at the initial position is restricted from moving in a direction separating from the fitting-side housing (toward a side opposite to the connection position) by locking the projection to the separation restricting stopper. The slide lever that is at the connection position is held in a state where a movement toward the initial position is restricted by looking the projection to the connected state holding stopper.

Connection of the housings is hindered if the slide lever is detached from the fitting-side housing. Thus, it is necessary to lock the separation restricting stopper and the projection with the slide lever held at the initial position. On the other hand, the slide lever at the connection position needs to be moved to the initial position to separate the housings. Thus, the connected state holding stopper and the projection preferably are held in a semi-locked state. However, since one projection is locked to the separation restricting stopper and to the connected state holding stopper, it has been difficult to set locking forces of the stoppers at both the initial position and the connection position.

To properly set the locking forces of the stoppers at both the initial position and the connection position, a projection for the initial position and a projection for the connection position having mutually different shapes and sizes may be formed separately, but the shape of the slide lever is complicated if two projections are formed.

The invention was completed on the basis of the above situation and aims to enable an operating member to be held with a proper force at both a partial locking position and a connection position without complicating the shape of the operating member.

SUMMARY

The invention is directed to a connector with a housing, and an operating member to be mounted into the housing while being slid. The operating member is slidable between a partial locking position and a full locking position forward of the partial locking position in a mounting direction on a mounting path. The housing is formed with a partial locking stopper and a full locking stopper. The operating member is formed with a single hook having a partial locking contact surface and a full locking contact surface. The partial locking contact surface is at an acute angle to a sliding direction of the operating member and restricts a movement of the operating member at the partial locking position in a direction separating from the housing by contacting the partial locking stopper. The full locking contact surface is at an obtuse angle to the sliding direction of the operating member and restricts a movement of the operating member at the full locking position toward the partial locking position by contacting the full locking stopper in a semi-locked state.

The movement of the operating member at the partial locking position in the direction separating from the housing is restricted by the contact of the partial locking stopper and the partial locking contact surface. The partial locking contact surface is at an acute angle to the sliding direction of the operating member, i.e. a mounting direction of the operating member into the housing. Thus, a locking force is high. The operating member at the full locking position is held at the full locking position by the contact of the full locking stopper and the full locking contact surface. The full locking stopper and the full locking contact surface contact each other in the semi-locked state. Thus, the operating member at the full locking position can be slid toward the partial locking position if a predetermined operation force is applied to the operating member. The partial locking contact surface and the full locking contact surface are formed on the single hook. Thus, the shape of the operating member can be simplified.

The partial locking stopper may be at an obtuse angle to the sliding direction of the operating member and achieves surface contact with the partial locking contact surface. Thus, a locking force between the partial locking stopper and the partial locking contact surface is enhanced and prevents separation of the operating member from the housing.

The hook may project in a direction interesting the sliding direction of the operating member, and the housing may be formed with a partial locking recess and a full locking recess. The partial locking stopper may be formed on an inner surface of the partial locking recess and the full locking stopper may be formed on an inner surface of the full locking recess. With this configuration, a movement of the operating member toward the full locking position is restricted by contact of the hook with the partial locking recess while the operating member is held at the partial locking position. With the operating member held at the full locking position, a movement of the operating member toward a side opposite to the partial locking position can be restricted by contact of the hook with the full locking recess.

The full locking contact surface may be closer to a tip side than the partial locking contact surface in a projecting direction of the hook, and an area between the partial locking recess and the full locking recess is facing a surface of the operating member forming the hook with a movement allowing space formed therebetween. According to this configuration, when the operating member slides between the partial locking position and the full locking position, frictional resistance between the hook and the facing surface of the housing facing the operating member is reduced.

The operating member may be a slide lever that exhibits a boosting function by sliding between the partial and full locking positions on the mounting path.

DETAILED DESCRIPTION

An embodiment of the invention is described with reference to FIGS. 1 to 10. In the following description, a right side in FIGS. 2 to 6 is defined as a front side concerning a front-rear direction. Upper and lower sides shown in FIGS. 1 to 10 are directly defined as upper and lower sides concerning a vertical direction.

Figure 9:
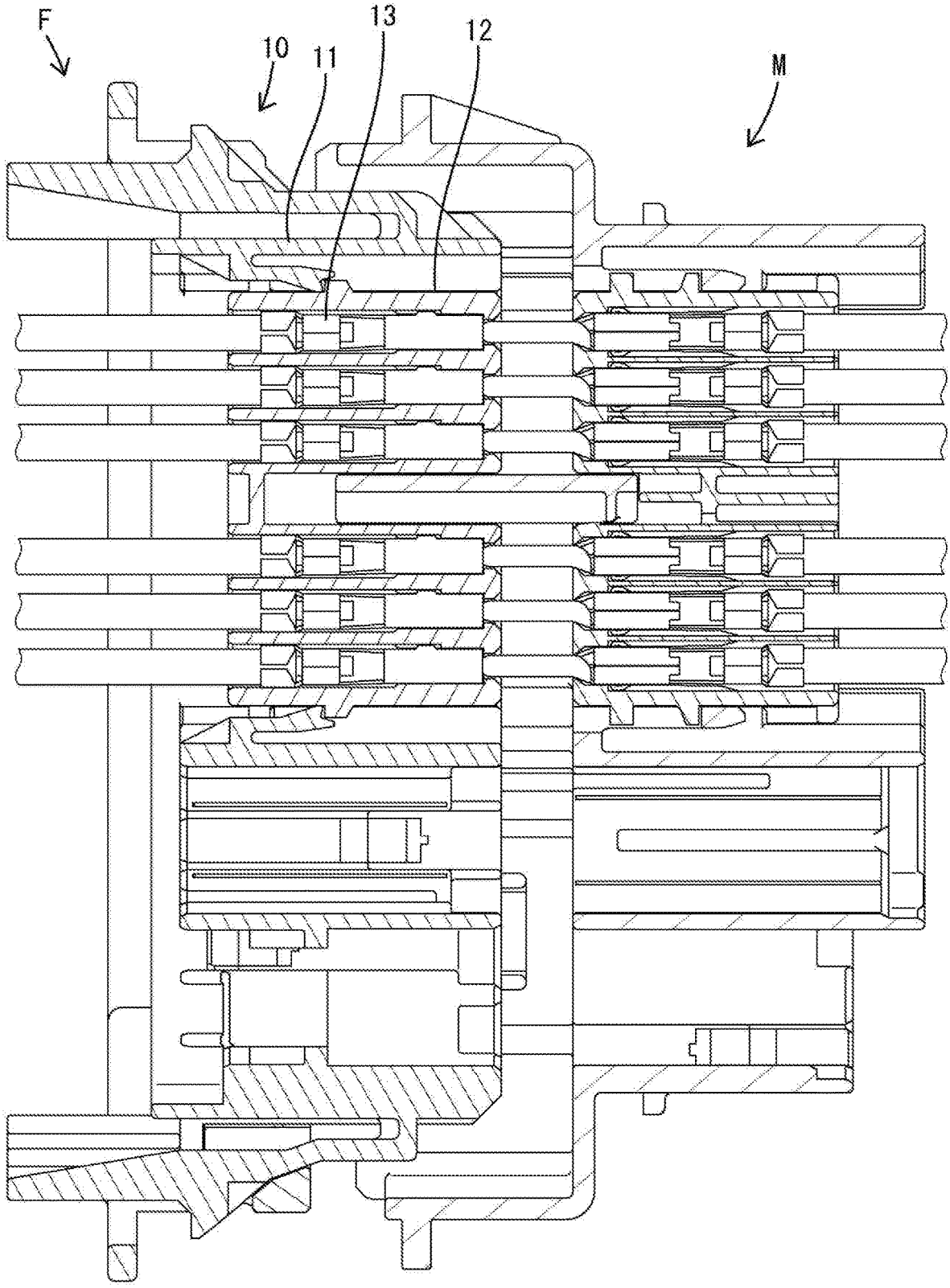
FIG. 9 is a side view in section showing a state where the connection of the connector and a mating connector is started.
Figure 10:
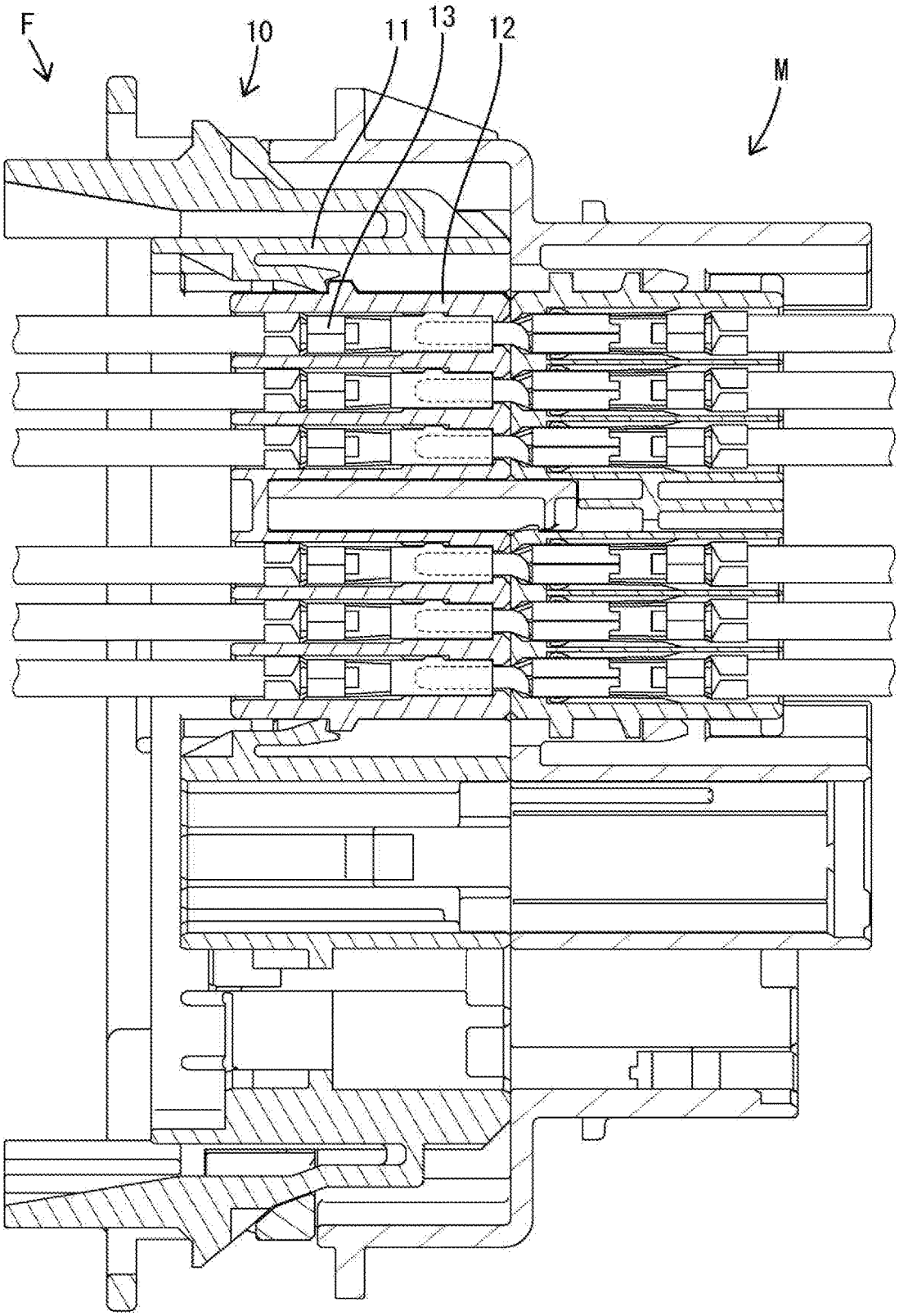
FIG. 10 is a side view in section showing a state where the connector and the mating connector are connected.

A female connector F of this embodiment includes a housing 10 made of synthetic resin and a slide lever 25 (operating member as claimed) made of synthetic resin. As shown in FIGS. 9 and 10, the housing 10 includes a frame 11 and sub-connectors 12 having female terminal fittings 13 accommodated therein. The housing is in the form of a block having a lateral dimension and a vertical dimension that is larger than a front-rear dimension.

The slide lever 25 is assembled with the housing 10 from above the housing 10. In an assembling process, the slide lever 25 slides down with respect to the housing 10. The slide lever 25 mounted in the housing 10 is slidable parallel to an assembling direction between a partial locking position (see FIGS. 3 and 4) and a full locking position (see FIGS. 5 and 6) located below the partial locking position.

The connectors F, M are fit shallowly together with the slide lever 25 held at the partial locking position (initial position). The slide lever 25 then is slid to the full locking position (connection position) so that a boosting function is exhibited and the connectors F, M can be connected with only a small operation force.

The connection of the connectors F, M is completed when the slide lever 25 reaches the full locking position. A moving direction of the slide lever 25 from the partial locking position to the full locking position is the same as the assembling direction of the slide lever 25 with the housing 10. A moving direction of the slide lever 25 from the full locking position to the partial locking position is the same as a moving direction when the slide lever 25 is separated from the housing 10.

The frame 11 (housing 10) is formed with left and right guide spaces 14 open in the upper surface of the frame 11. The openings of the guide spaces 14 in the upper surface of the frame 11 have a slit shape with a front-rear dimension larger than a lateral dimension. The inner surfaces of the guide space 14 include front and rear facing surfaces 15 and 16 that face parallel to each other in the front-rear direction. The front facing surface 15 extends straight in the vertical direction and is continuous from the upper end to the lower end of the guide space 14.

The rear facing surface 16 is composed of an upper facing surface 17, an intermediate facing surface 18 (area between a partial locking recess and a full locking recess as claimed) spaced apart from and below the upper facing surface 17 and a lower facing surface 19 spaced apart from and below the intermediate facing surface 17.

Figure 1:
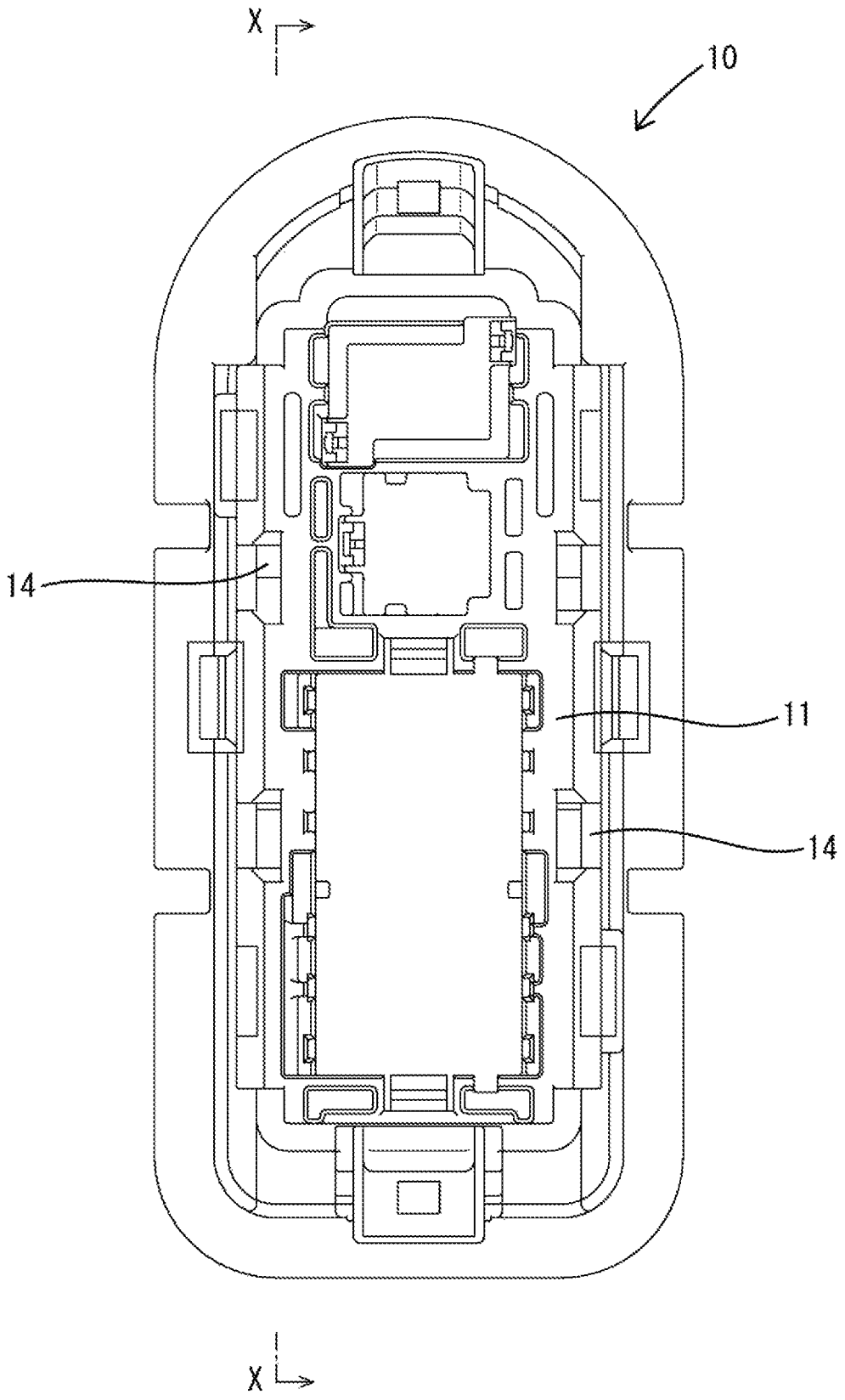
FIG. 1 is a front view of a housing constituting a connector of an embodiment.
Figure 2:
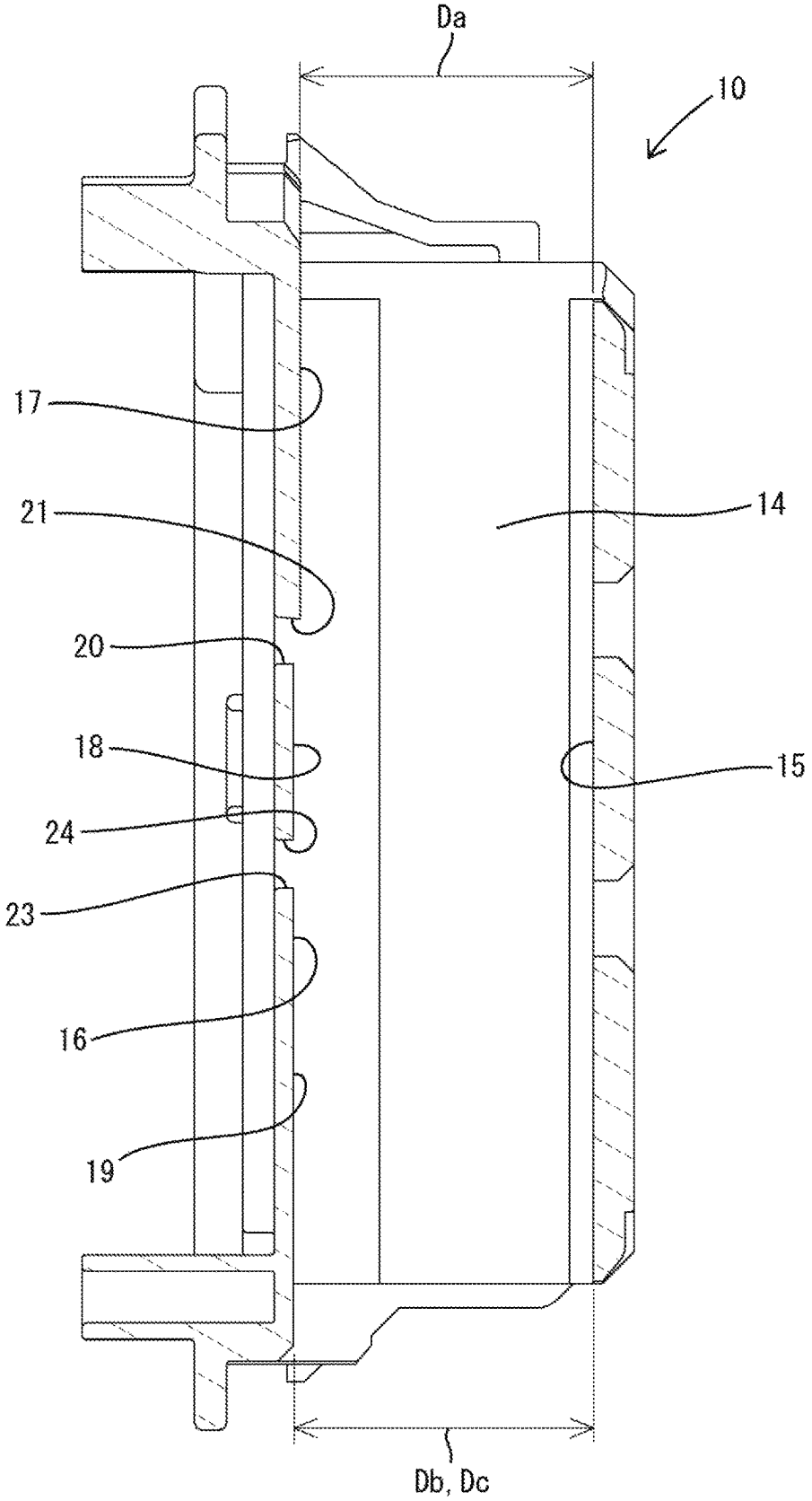
FIG. 2 is a section along X-X of FIG. 1.

As shown in FIG. 2, it is assumed that Da denotes an opposing distance between the upper facing surface 17 and the front facing surface 15 in the front-rear direction, Db denotes an opposing distance between the intermediate facing surface 18 and the front facing surface 15 in the front-rear direction and Dc denotes an opposing distance between the lower facing surface 19 and the front facing surface 15 in the front-rear direction. These opposing distances Da, Db and Dc satisfy a relationship of Da>Db=Dc. However, a dimensional difference between Da, Db and Dc is very small.

A wall constituting the rear facing surface 16 of the frame 11 is formed with a partial locking recess 20 and a full locking recess 23 open to the guide space 14. The partial locking recess 20 is between the lower end of the upper facing surface 17 and the upper end of the intermediate facing surface 18. The full locking recess 23 is between the lower end of the intermediate facing surface 18 and the upper end of the lower facing surface 19.

Figure 4:
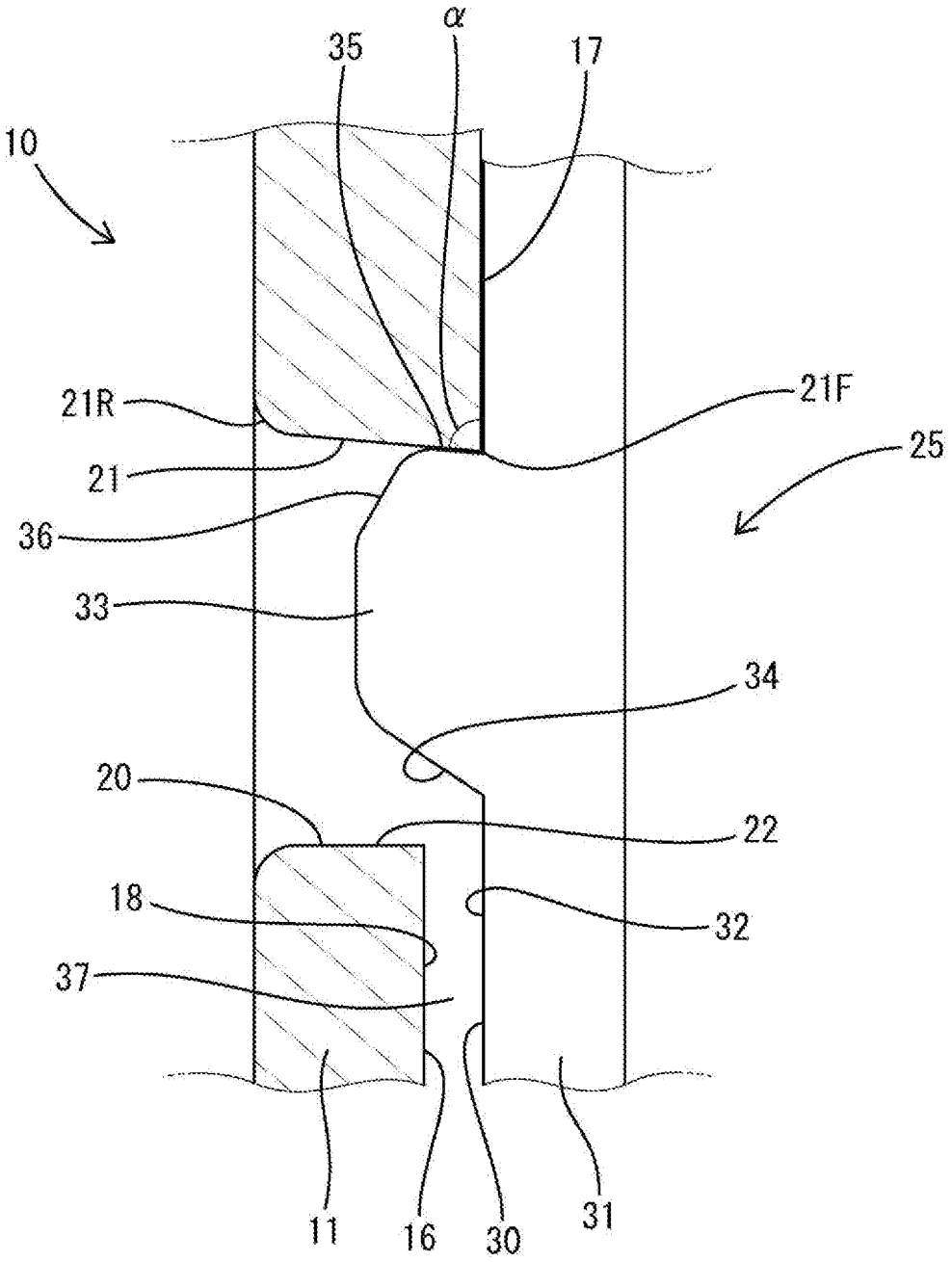
FIG. 4 is a partial enlarged view of FIG. 3.

As shown in FIG. 4, the partial locking recess 20, the upper inner surface of the partial locking stopper 21 functions as a partial locking stopper 21. The partial locking stopper 21 is at an oblique angle close to a right angle to a sliding direction of the slide lever 25 to be described later (length direction of the front and rear facing surfaces 15, 16). A front edge 21F (opening edge to the guide space 14) of the partial locking stopper 21 is at a position lower than a rear end edge 21R of the partial locking stopper 21. Accordingly, an angle $\alpha$ between the upper facing surface 17 and the partial locking stopper 21 is an acute angle close to a right angle. The lower inner surface of the partial locking recess 20 functions as a temporary holding portion 22 and is at a right angle to the sliding direction of the slide lever 25.

Figure 6:
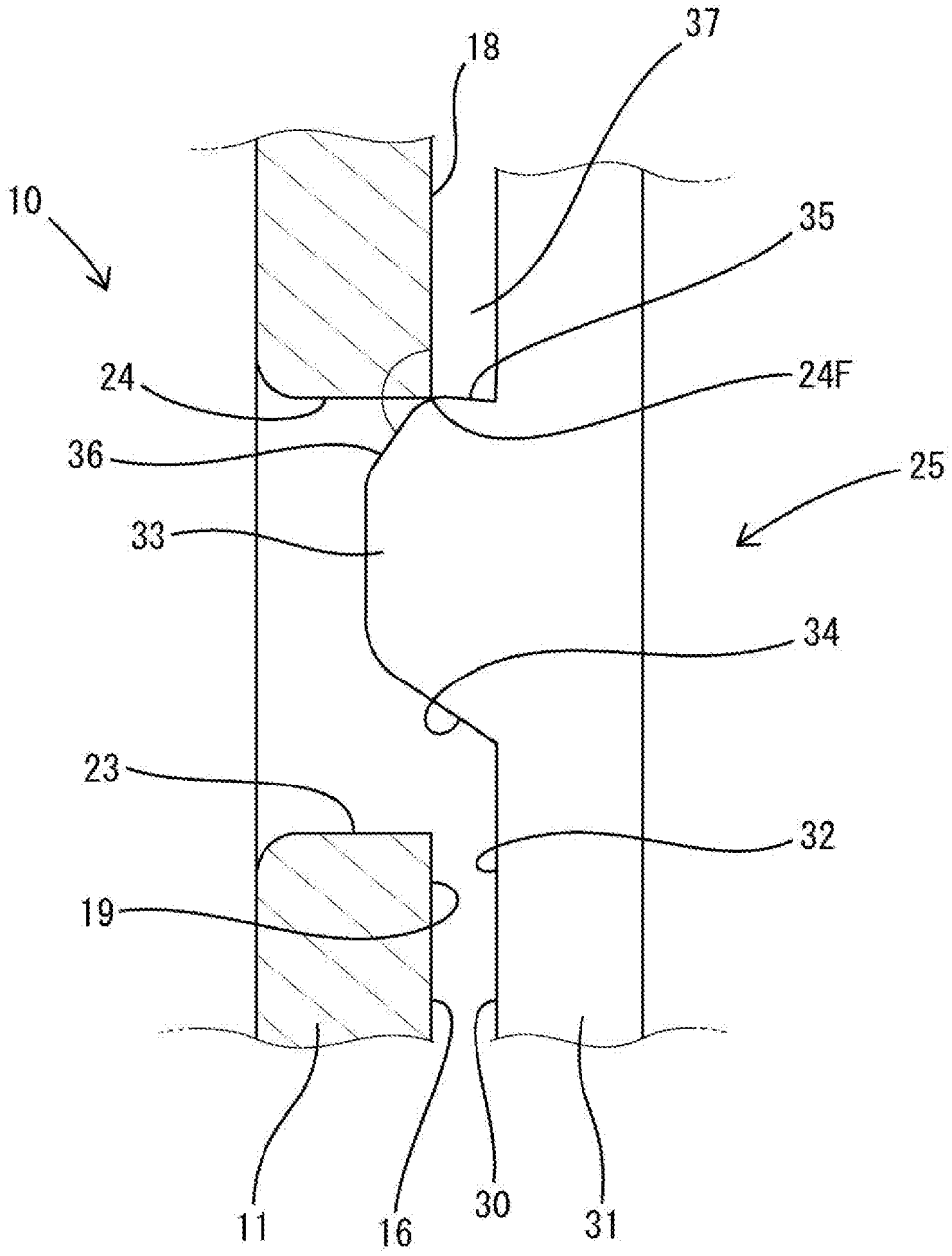
FIG. 6 is a partial enlarged view of FIG. 5.

As shown in FIG. 6, the upper inner surface of the full locking recess 23 functions as a full locking stopper 24. The full locking stopper 24 is at a right angle to the sliding direction of the slide lever 25 (length direction of the front and rear facing surfaces 15, 16). A front end edge 24F of the full locking stopper 24 is behind the front edge 21F of the partial locking stopper 21, i.e. at a position retracted from the guide space 14, in the front-rear direction (direction perpendicular to the sliding direction of the slide lever 25).

Figure 3:
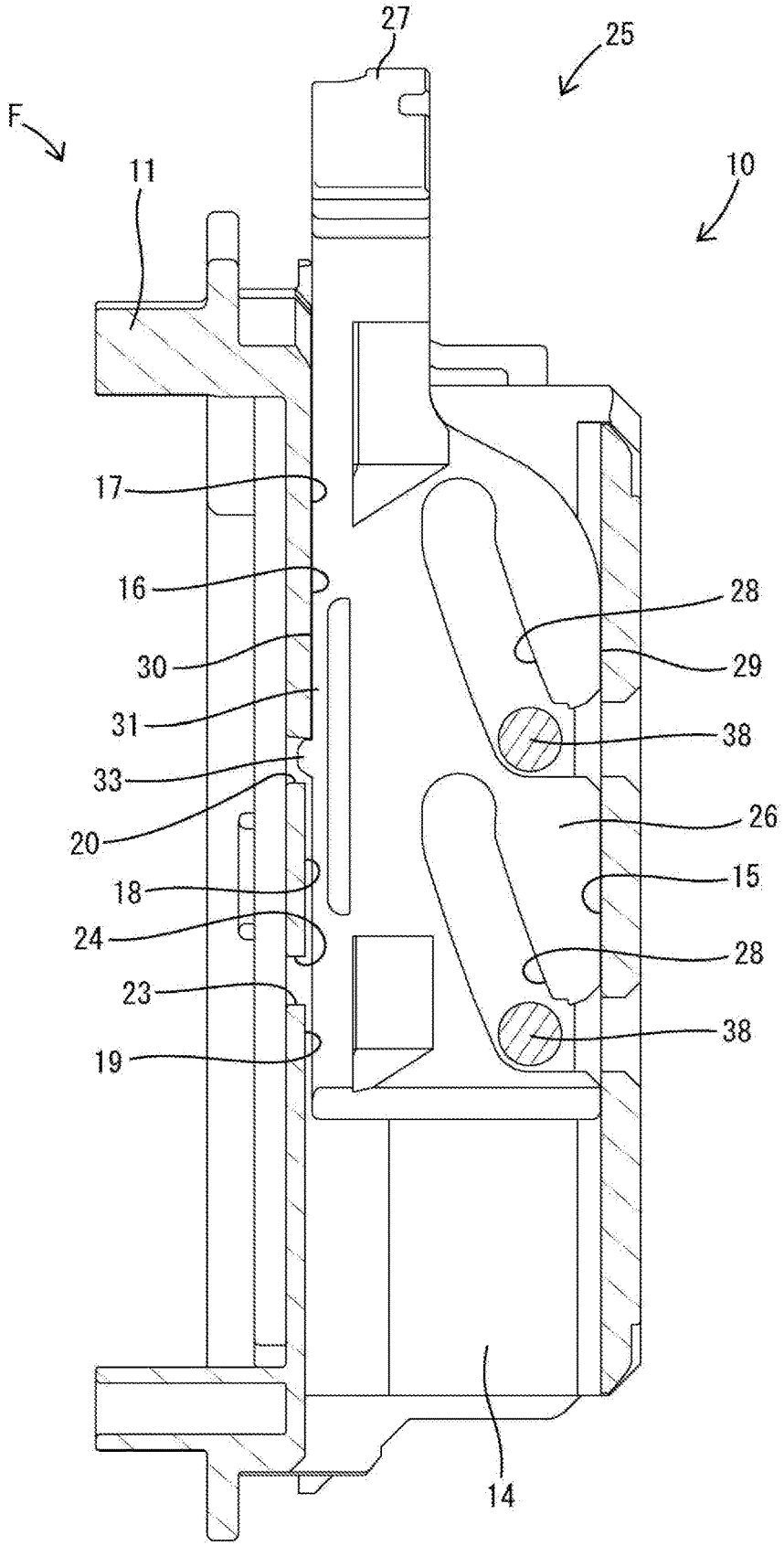
FIG. 3 is a section along X-X showing a state where a slide lever is held at a partial locking position.
Figure 5:
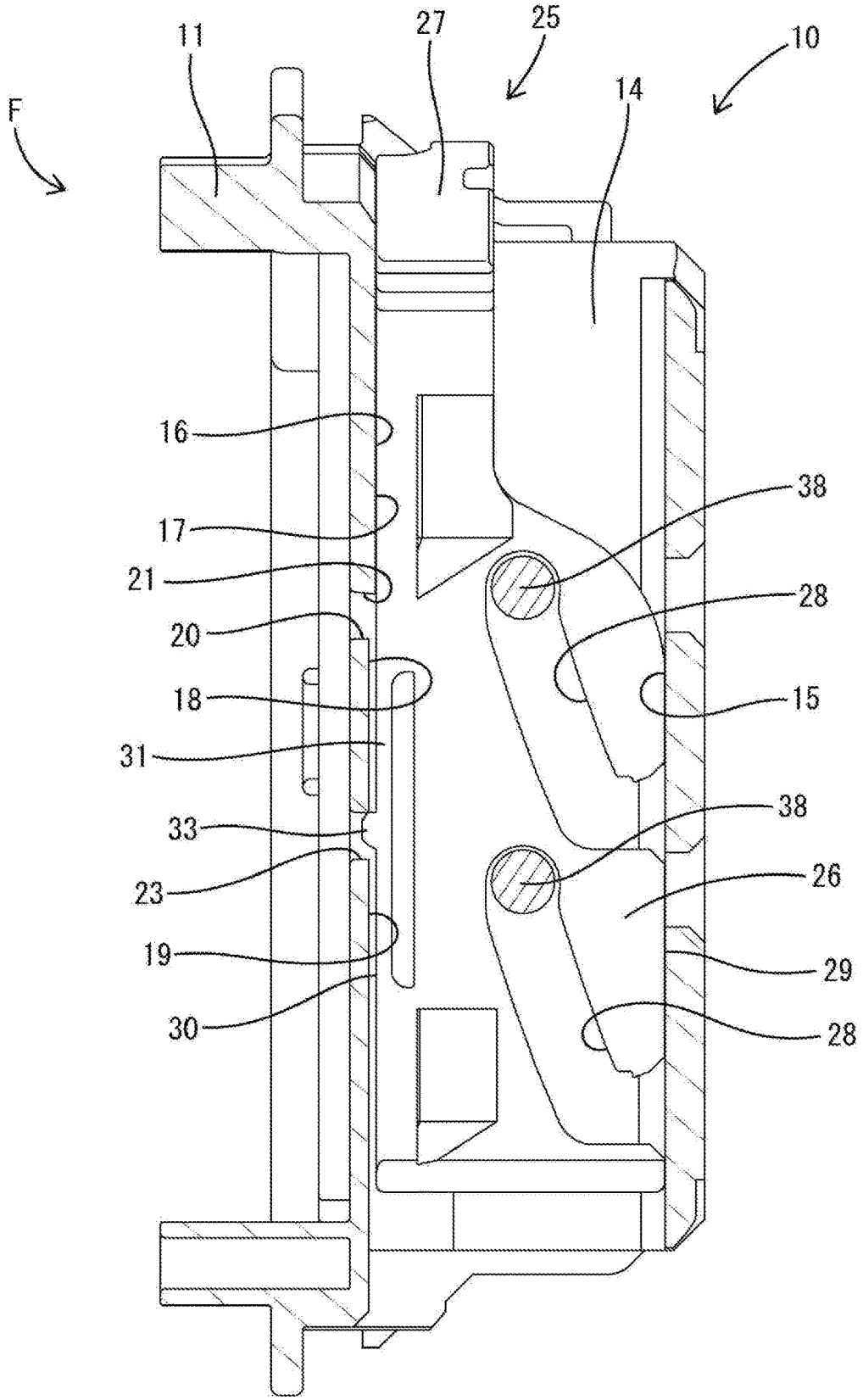
FIG. 5 is a section along X-X showing a state where the slide lever is held at a full locking position.
Figure 7:
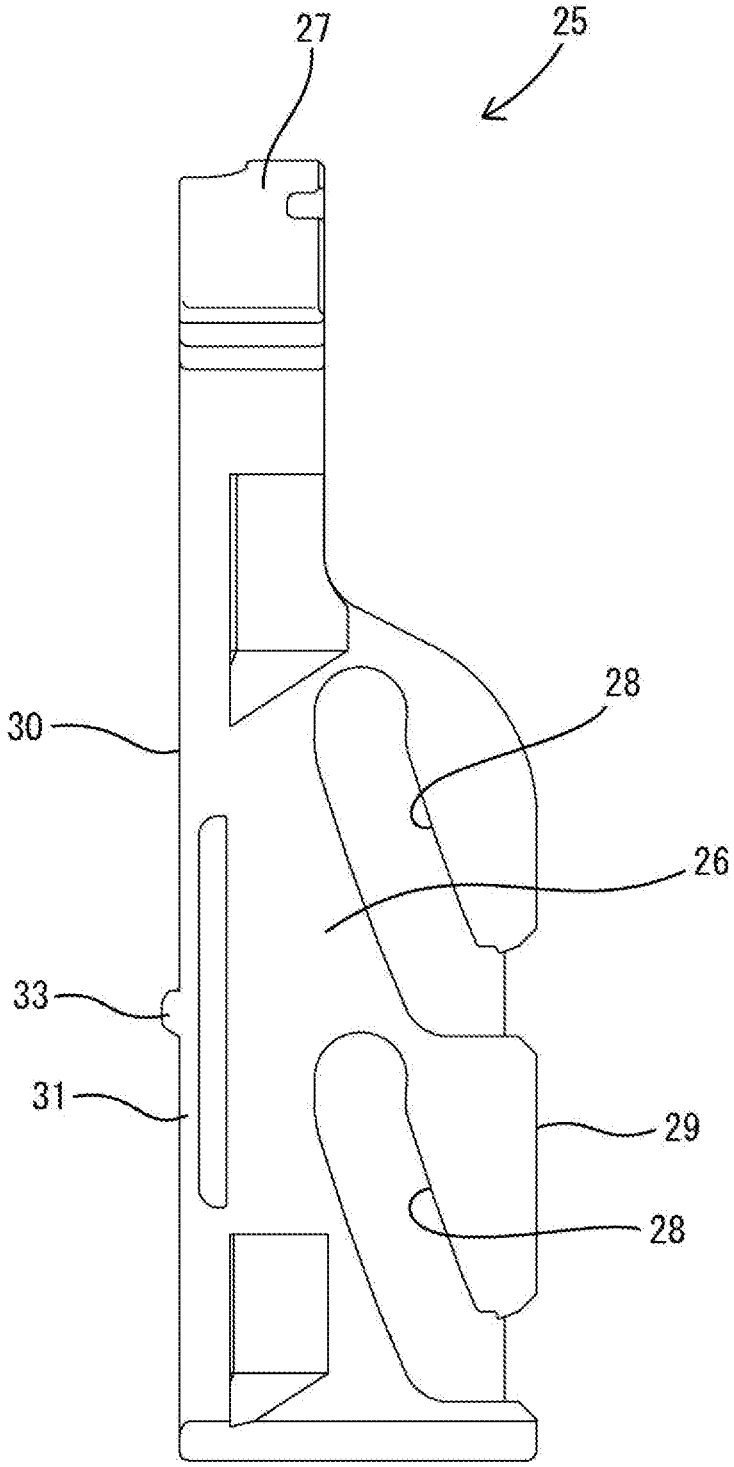
FIG. 7 is a side view of the slide lever.
Figure 8:
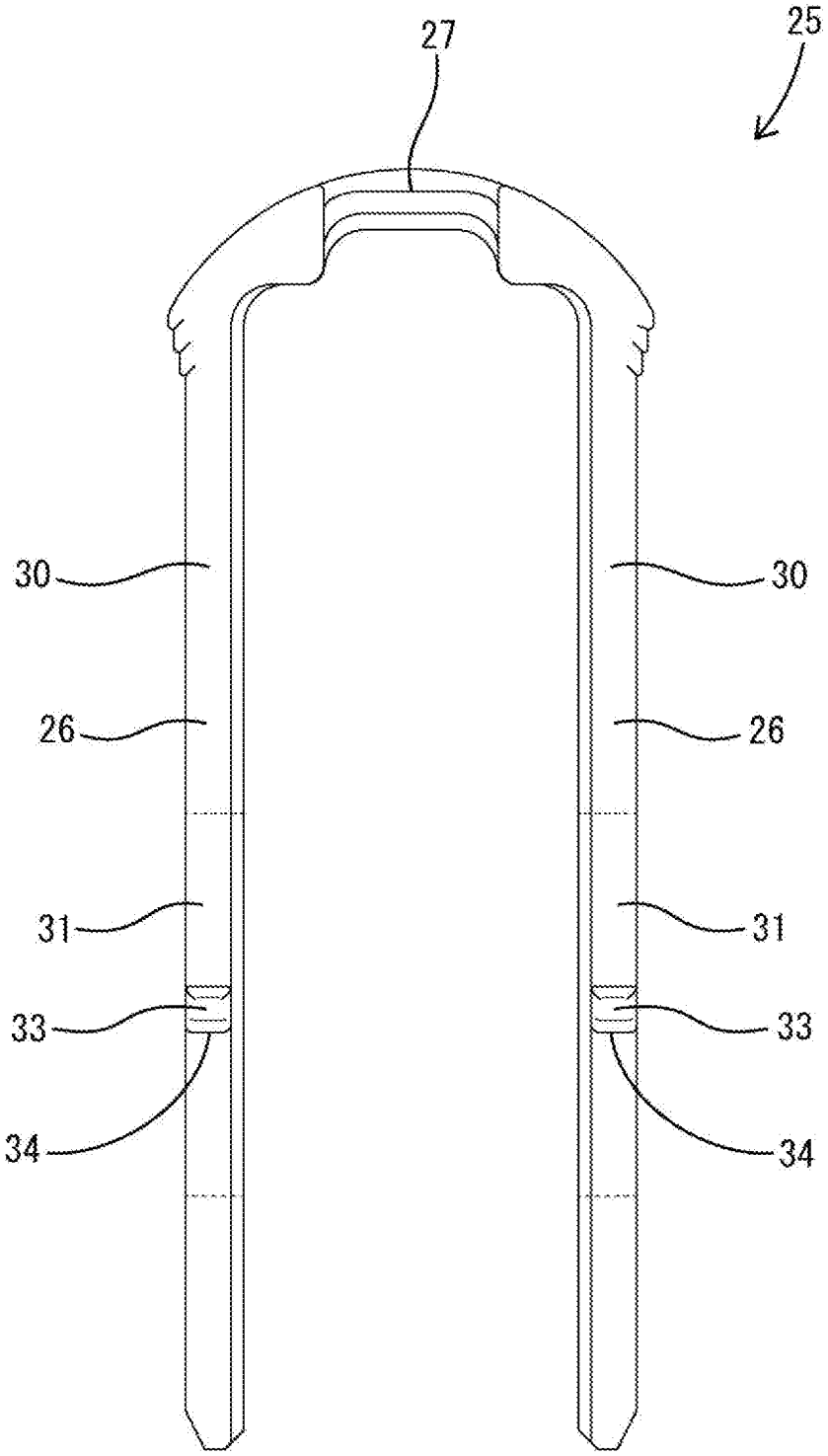
FIG. 8 is a back view of the slide lever.

As shown in FIGS. 7 and 8, the slide lever 25 is a single member including left and right arms 26 and an operating portion 27 coupling upper end parts of the arms 26. The arm 26 is substantially in the form of a flat plate whose plate thickness direction is oriented in the lateral direction, and is long in the vertical direction (direction parallel to the sliding direction of the slide lever 25). The arm 26 is formed with upper and lower cam grooves 28 extending in a direction oblique to the sliding direction. In the process of sliding the slide lever 25 between the partial locking position and the full locking position, the cam grooves 28 and cam followers 38 of the male connector M slide in contact, as shown in FIGS. 3 and 5, to exhibit the boosting function.

A front slide-contact surface 29 is formed on a front of the arm 26 and extends parallel to the sliding direction of the slide lever 25, and a rear slide-contact surface 30 is formed on a rear edge of the arm 26 and extends parallel to the sliding direction of the slide lever 25. A resilient deflecting portion 31 is formed in a vertically intermediate part of the rear edge of the arm 26 and is elongated in the vertical direction and supported on both ends on the arm 26. The resilient deflecting portion 31 is resiliently deformable to be curved in the front-rear direction with both upper and lower ends as supports.

A hook 33 projecting rearward from a rear outer surface 32 (surface of the operating member forming the hooking portion as claimed) of the resilient deflecting portion 31 is formed substantially in a vertically central part of the resilient deflecting portion 31. The lower surface of the hook 33 serves as a temporary holding contact surface 34. The temporary holding contact surface 34 is connected at an obtuse angle to the rear outer surface 32 and faces in the same direction as a moving direction of the slide lever 25 from the partial locking position to the full locking position.

A partial locking contact surface 35 and a full locking contact surface 36 are formed on the upper surface of the hook 33 to be adjacent in the front-rear direction (direction perpendicular to the sliding direction of the slide lever 25 with respect to the housing 10 and parallel to a resilient displacing direction of the resilient deflecting portion 31). The partial locking contact surface 35 and the full locking contact surface 36 face in a direction (direction of separating the slide lever 25 from the housing 10) opposite to a mounting direction of the slide lever 25 into the housing 10.

The partial locking contact surface 35 is disposed on a base end part in a projecting direction of the hook 33. The partial locking contact surface 35 is connected at an acute angle close to a right angle to the rear outer surface 32 (sliding direction of the slide lever 25 with respect to the housing 10). An angle $\alpha$ between the rear outer surface 32 and the partial locking contact surface 35 is equal to the angle $\alpha$ between the upper facing surface 17 and the partial locking stopper 21.

The full locking contact surface 36 is on a tip part in the projecting direction of the hook 33, and the partial locking contact surface 35 is interposed between the full locking contact surface 36 and the rear outer surface 32. The full locking contact surface 36 is at an obtuse angle to the rear outer surface 32. The partial locking contact surface 35 and the full locking contact surface 36 are connected at an obtuse angle.

In mounting the slide lever 25 into the housing 10, the arms 26 are inserted into the guide spaces 14 from above the housing 10 and the slide lever 25 is slid while the front slide-contact surfaces 29 are caused to slide in contact with the front facing surfaces 15 and the rear slide-contact surfaces 30 are caused to slide in contact with the rear facing surfaces 16 (upper facing surfaces 17).

The hooks 33 are in the partial locking recesses 20, as shown in FIGS. 3 and 4 when the slide lever 25 is mounted at the partial locking position with respect to the housing 10. An attempt may be made to move the slide lever 25 up and to separate the slide lever 25 from the housing 10 in this state. However, the partial locking contact surfaces 35 come into surface contact with (butt against) front end parts of the partial locking stoppers 21 while facing upward to prevent an upward movement of the slide lever 25.

Further, the partial locking contact surfaces 35 and the partial locking stoppers 21 are at an acute angle to the rear outer surfaces 32. Thus, corners formed by lower parts of the upper facing surfaces 17 and the front parts of the partial locking stoppers 21 bite into recesses formed by the rear outer surfaces 32 and the partial locking contact surfaces 35 if the slide lever 25 is going to move up. This biting action increases contact margins (locking margins) of the partial locking contact surfaces 35 with the partial locking stoppers 21 in the front-rear direction. Thus, the separation of the slide lever 25 at the partial locking position from the housing 10 is prevented.

The semi-locked state is set by the temporary holding contact surfaces 34 contacting (butting against) the front edges of the temporary holding portions 22 while facing down with the hooks 33 accommodated in the partial locking recesses 20, thereby restricting a movement of the slide lever 25 from the partial locking position toward the full locking position. In this way, the slide lever 25 is held at the partial locking position.

If a downward operation force exceeding a locking force between the temporary holding contact surfaces 34 and the temporary holding portions 22 is applied to the operating portion 27, the slide lever 25 moves toward the full locking position while resiliently displacing the resilient deflecting portion 31 forward (away from the rear facing surface 16). Projecting end parts (rear end parts) of the hooks 33 slide in contact with the intermediate facing surfaces 18 in a moving process. Thus, frictional resistance is created between the hooks 33 and the intermediate facing surfaces 18. Movement allowing spaces 37 are secured between areas of the rear outer surfaces 32 of the slide lever 25 below the hooks 33 and the intermediate facing surfaces 18 with the slide lever 25 held at the partial locking position. Thus, as compared to the case where the movement allowing spaces 37 are not formed, resilient displacement amounts of the resilient deflecting portions 31 can be small and, accordingly, the frictional resistance between the hooks 33 and the intermediate facing surfaces 18 is reduced.

When the slide lever 25 reaches the connection position, the resilient deflecting portions 31 resiliently return and the hooks 33 are accommodated into the full locking recesses 23, as shown in FIGS. 5 and 6. If an attempt is made to move the slide lever 25 up and to return the slide lever 25 to the partial locking position in this state, the full locking contact surfaces 36 come into line contact with (butt against) the front end edges of the full locking stoppers 24 while facing upward. This butting of the full locking contact surfaces 36 against the full locking stoppers 24 restricts the slide lever 25 from moving to the partial locking position and holds the slide lever 25 at the full locking position.

If an upward operation force exceeding a locking force acting between the full locking contact surfaces 36 and the full locking stoppers 24 is applied to the operating portion 27 (slide lever 25), the slide lever 25 moves toward the full locking position while resiliently displacing the resilient deflecting portion 31 forward. The projecting end parts (rear end parts) of the hooks 33 slide in contact with the intermediate facing surfaces 18 in a moving process. However, the movement allowing spaces 37 are secured between the rear outer surfaces 32 and the intermediate facing surfaces 18 as described above. Thus, frictional resistance between the hooks 33 and the intermediate facing surfaces 18 is reduced. When the slide lever 25 reaches the partial locking position, the resilient deflecting portions 31 resiliently return and the hooks 33 are accommodated into the partial locking recesses 20.

A state where the slide lever 25 is held at the partial locking position and a state where the slide lever 25 is held at the full locking position are compared. At the partial locking position, the reverse tapered partial locking contact surfaces 35 are locked to the partial locking stoppers 21 to prevent upward separation of the slide lever 25 from the housing 10. In contrast, at the full locking position, the forward tapered full locking contact surfaces 36 are locked to the full locking stoppers 24 to prevent an upward movement of the slide lever 25 toward the partial locking position. Thus, a locking force acting between the partial locking stoppers 21 and the partial locking contact surfaces 35 is larger than that acting between the full locking contact surfaces 36 and the full locking stoppers 24.

As described above, the female connector F enables the slide lever 25 to be held at both the partial locking position and the connection position with a proper force without complicating the shape of the slide lever 25. Specifically, the female connector F includes the housing 10 and the slide lever 25 mountable into the housing 10. The slide lever 25 is slidable between the partial locking position and the full locking position forward (downward) of the partial locking position in the mounting direction on a mounting path. The slide lever 25 exhibits the boosting function by sliding between the partial locking position and the full locking position on the mounting path.

The housing 10 is formed with the partial locking stopper 21 and the full locking stopper 24. The slide lever 25 is formed with the single hook 33 having the partial locking contact surface 35 and the full locking contact surface 36. The partial locking contact surface 35 is at an acute angle to the sliding direction of the slide lever 25, and restricts a movement of the slide lever 25 at the partial locking position in the direction separating from the housing 10 by contacting the partial locking stopper 21. The full locking contact surface 36 is at an obtuse angle to the sliding direction of the slide lever 25 and suppresses a movement of the slide lever 25 at the full locking position toward the partial locking position by contacting the full locking stopper 24 in the semi-locked state.

According to the above configuration, the slide lever 25 at the partial locking position is restricted from moving in the direction separating from the housing 10 by the contact of the partial locking stopper 21 and the partial locking contact surface 35. Since the partial locking contact surface 35 is at an acute angle to the sliding direction of the slide lever 25, i.e. the mounting direction of the slide lever 25 into the housing 10, the locking force is relatively high. The slide lever 25 at the full locking position is held at the full locking position by the contact of the full locking stopper 24 and the full locking contact surface 36.

Since the full locking stopper 24 and the full locking contact surface 36 contact each other in the semi-locked state, the slide lever 25 at the full locking position can be slid toward the partial locking position if a predetermined operation force is applied to the slide lever 25. Since the partial locking contact surface 35 and the full locking contact surface 36 are formed on the single hooking portion 33 in the female connector F of this embodiment, the shape of the slide lever 25 can be simplified.

Further, the partial locking stopper 21 is at an obtuse angle to the sliding direction of the slide lever 25 and can come into surface contact with the partial locking contact surface 35. According to this configuration, since the locking force acting between the partial locking stopper 21 and the partial locking contact surface 35 is enhanced, the separation of the slide lever 25 from the housing 10 can be reliably prevented.

Further, the hooking portion 33 is shaped to project from the rear outer surface 32 of the resilient deflecting portion 31 in a direction (rearward direction) intersecting the sliding direction of the slide lever 25. The housing 10 is formed with the partial locking recess 20 including the partial locking stopper 21 on the inner surface and the full locking recess 23 including the full locking stopper 24 on the inner surface. According to this configuration, with the slide lever 25 held at the partial locking position, the hooking portion 33 contacts the partial locking recess 20, whereby a movement of the slide lever 25 toward the full locking position can be restricted. With the slide lever 25 held at the full locking position, the hooking portion 33 contacts the full locking recess 23, whereby a movement of the slide lever 25 toward a side opposite to the partial locking position can be restricted.

Further, the full locking contact surface 36 is disposed closer to the tip side than the partial locking contact surface 35 in the projecting direction of the hooking portion 33 (front-rear direction). Since the partial locking stopper 21 is vertically facing not only the partial locking contact surface 35, but also the full locking contact surface 36, a facing area of the hooking portion 33 and the partial locking stopper 21 in the front-rear direction (resilient displacing direction of the resilient deflecting portion 31) is relatively large. Thus, the resilient displacement amount of the resilient deflecting portion 31 has to be relatively large to release the locked state of the hooking portion 33 and the partial locking stopper 21.

In contrast, the full locking stopper 24 is vertically facing the full locking contact surface 36, but not facing the partial locking contact surface 35. Accordingly, the facing area of the hooking portion 33 and the full locking stopper 24 in the front-rear direction is smaller than that of the partial locking stopper 21 and the hooking portion 33. Thus, an operation of returning the slide lever 25 to the partial locking position can be relatively easily realized with the slide lever 25 held at the partial locking position while the separation of the slide lever 25 from the housing 10 is reliably prevented with the slide lever 25 held at the partial locking position.

Further, an area (intermediate facing surface 18) between the partial locking recess 20 and the full locking recess 23, out of the facing surface (rear facing surface 16) of the housing 10 facing the slide lever 25 is facing the surface of the slide lever 25 forming the hooking portion 33 (rear outer surface 32) with the movement allowing space 37 formed therebetween. According to this configuration, when the slide lever 25 slides between the partial locking position and the full locking position, friction resistance between the hooking portion 33 and the rear facing surface 16 (intermediate facing surface 18) is reduced.

The invention is not limited to the above described and illustrated embodiment. For example, the following embodiments also are included in the scope of the invention.

Although the operating member is the slide lever that exhibits the boosting function by sliding between the partial locking position (initial position) and the full locking position (connection position) on the mounting path in the above embodiment, the operating member may be a retainer that slides between a partial locking position where the insertion and withdrawal of the terminal fittings into and from the housing are permitted and a full locking position where the terminal fittings inserted into the housing are retained.

Although the partial locking stopper can come into surface contact with the partial locking contact surface in the above embodiment, the partial locking stopper and the partial locking contact surface may come into line contact or point contact.

Although the full locking stopper can come into line contact or point contact with the full locking contact surface in the above embodiment, the full locking stopper and the full locking contact surface may come into surface contact.

Although the resilient deflecting portion is supported on both ends on the arm in the above embodiment, the resilient deflecting portion may be cantilevered from the arm portion.

LIST OF REFERENCE SIGNS

F . . . female connector (connector)
10 . . . housing
16 . . . rear facing surface (facing surface of housing facing operating member)
18 . . . intermediate facing surface (area between partial locking recess and full locking recess)
20 . . . partial locking recess
21 . . . partial locking stopper
23 . . . full locking recess
24 . . . full locking stopper
25 . . . slide lever (operating member)
32 . . . rear outer surface (surface of the operating member forming hook)
33 . . . hook
35 . . . partial locking contact surface
36 . . . full locking contact surface
37 . . . movement allowing space

What is claimed is:

1. A connector, comprising:

a housing; and an operating member to be mounted into the housing while being slid, the operating member being slidable between a partial locking position and a full locking position forward of the partial locking position in a mounting direction on a mounting path;

wherein:

the housing is formed with a partial locking stopper and a full locking stopper;

the operating member is formed with a single hook having a partial locking contact surface and a full locking contact surface;

the partial locking contact surface is at an acute angle to a sliding direction of the operating member and restricts a movement of the operating member at the partial locking position in a direction separating from the housing by contacting the partial locking stopper; and the full locking contact surface is at an obtuse angle to the sliding direction of the operating member and restricts a movement of the operating member at the full locking position toward the partial locking position by contacting the full locking stopper in a semi-locked state.

2. The connector of claim 1, wherein the partial locking stopper is at an obtuse angle to the sliding direction of the operating member and capable of coming into surface contact with the partial locking contact surface.

3. The connector of claim 2, wherein:

the hook is shaped to project in a direction intersecting the sliding direction of the operating member; and the housing is formed with a partial locking recess including the partial locking stopper on an inner surface and a full locking recess including the full locking stopper on an inner surface.

4. The connector of claim 3, wherein:

the full locking contact surface is disposed closer to a tip side than the partial locking contact surface in a projecting direction of the hook; and an area between the partial locking recess and the full locking recess is facing a surface of the operating member forming the hook with a movement allowing space formed therebetween.

5. The connector of claim 4, wherein the operating member is a slide lever that exhibits a boosting function by sliding between the partial locking position and the full locking position on the mounting path.

6. The connector of claim 1, wherein:

the hook is shaped to project in a direction intersecting the sliding direction of the operating member; and the housing is formed with a partial locking recess including the partial locking stopper on an inner surface and a full locking recess including the full locking stopper on an inner surface.

7. The connector of claim 6, wherein:

the full locking contact surface is disposed closer to a tip side than the partial locking contact surface in a projecting direction of the hook; and an area between the partial locking recess and the full locking recess is facing a surface of the operating member forming the hook with a movement allowing space formed therebetween.

8. The connector of claim 1, wherein the operating member is a slide lever that exhibits a boosting function by sliding between the partial locking position and the full locking position on the mounting path.

* * * * *